United States Patent [19]

Betts

[11] 4,280,676

[45] Jul. 28, 1981

[54] DEVICE FOR HOLDING FLEXIBLE BAGS

[76] Inventor: William M. Betts, 3217 Canyon St., Memphis, Tenn. 38134

[21] Appl. No.: 820,751

[22] Filed: Aug. 1, 1977

[51] Int. Cl.[3] ..... B65B 67/04

[52] U.S. Cl. ..... 248/97; 141/316; 141/390; 248/99

[58] Field of Search ..... 248/97, 99; 232/43.2, 232/43.1; 220/63 R; 141/316, 390, 391

[56] References Cited

U.S. PATENT DOCUMENTS

| | | | |
|---|---|---|---|
| 1,052,379 | 2/1913 | Ranken et al. | 248/97 X |
| 2,319,384 | 5/1943 | Callan et al. | 248/99 X |
| 2,817,476 | 12/1957 | Mills | 232/43.1 |
| 3,095,172 | 6/1963 | Dwyer | 248/97 |
| 3,115,986 | 12/1963 | Groff | 232/43.2 X |
| 3,784,049 | 1/1974 | Hawk | 248/99 X |
| 3,815,778 | 6/1974 | Martin | 220/63 R X |
| 3,818,956 | 6/1974 | Chamberlain | 248/99 X |
| 3,915,329 | 10/1975 | Zaks | 220/63 R X |
| 4,014,157 | 3/1977 | Pearce | 141/390 X |
| 4,054,225 | 10/1977 | Frech | 220/63 R |

*Primary Examiner*—Rodney H. Bonck
*Attorney, Agent, or Firm*—Walker & McKenzie

[57] ABSTRACT

A device for holding a flexible, nonselfsupporting bag in an opened position for allowing the bag to be filled with leaves, grass or the like. The device includes a body member having a cavity therethrough substantially in the shape of a truncated right cone with the large end of the cone normally directed downward. The bag is inserted into the hollow body member and the mouth of the bag is attached to the top of the body member in an opened position. Once the bag is filled, the mouth of the bag is detached from the top of the body member and the body member is lifted over the bag. The sloping sides of the cavity in the body member makes the device easy to lift over the filled bag.

8 Claims, 3 Drawing Figures

DEVICE FOR HOLDING FLEXIBLE BAGS

BACKGROUND OF THE INVENTION

1. Field of the Invention

This invention relates generally to means for holding flexible bags opened to aid in the filling thereof.

2. Description of the Prior Art

Heretofore, various means have been developed for holding flexible, nonselfsupporting bags in opened positions for allowing the bags to be filled. See, for example, Ranken et al, U.S. Pat. No. 1,052,379; Carlson, U.S. Pat. No. 2,678,764; Dwyer, U.S. Pat. No. 3,095,172; Koger, U.S. Pat. No. 3,614,041; Vandermast, U.S. Pat. No. 3,627,242; and Pearce, U.S. Pat. No. 4,014,157. None of the above patents disclose or suggest the present invention.

One of the most difficult jobs a home owner has in taking care of his property is bagging leaves or grass that has been cut with a lawnmower or the like. The individual at this juncture has to bag or box the leaves or grass. Most people utilize flexible, nonselfsupporting plastic bags to contain such refuse because of the price and availability thereof. Filling such a plastic bag without the help of another person holding the bag opened is, at best, difficult. One common procedure is to insert the plastic bag to be filled into a standard garbage can that is substantially equal in size to that of the plastic bag. The person places the bag inside the garbage can and secures the top of the bag around the top of the garbage can by merely turning or cuffing the top of the bag over the top of the garbage can. Two distinct difficulties are inherent in this method: (1) In inserting a plastic bag inside a garbage can, air is trapped between the bag and the can, causing the bag to inflate as refuse is placed in the bottom of the bag. When this occurs, one has to stop filling the bag and release the top of the bag from the garbage can so that air will escape and deflate the bag. This is time-consuming. (2) Once the bag inside the garbage can is filled, the next task is to remove the filled bag. After securing the top of the plastic bag with ties or the like, one can attempt to lift the bag out of the can. In many cases, the bag will be torn if diligent care is not taken in lifting the bag out. The garbage can may, on the other hand, be merely turned over and shaken to cause the bag to fall out. If care is not used in doing this, the bag can be ruptured.

While the above cited patents disclose devices for holding flexible bags open other than garbage cans, these prior devices include one or more of the following disadvantages:

1. Requires ancillary devices that can be lost or used as toys, etc.
2. Requires some dexterity in separating the device from the filled bag, e.g., one hand has to hold the bag while the other hand has to remove the device therefrom.
3. Compacting of material within the flexible bag can't be accomplished unless the device is used by two people.
4. The bag can't be filled to its ultimate capacity because of the difficulty required in separating the device and the bag.
5. Large bags of the 55 gallon capacity and the like can't be utilized by one person because of the inherent difficulty in separating the device and the filled bag.

6. The bag-engaging surface of the device will become marred or scarred, unless due care in storage is taken, making removal of the device from the bag difficult.
7. Expensive to fabricate and distribute.

SUMMARY OF THE INVENTION

This invention is directed towards overcoming the problems and disadvantages of prior means for holding flexible, nonselfsupporting bags in opened positions to allow the bags to be filled. The concept of the present invention is to provide a means which holds a flexible, nonselfsupporting bag in an opened position to allow the bag to be easily filled and which, when the bag is filled, can be easily removed from the bag without likelihood of damage to the bag.

The device of the present invention comprises, in general, a body member including a normally upwardly directed end and a normally downwardly directed end and having a cavity extending completely therethrough from the normally upwardly directed end to the normally downwardly directed end for receiving a flexible, nonselfsupporting bag. The cavity preferably constantly increases in cross-sectional area as it extends from the normally upwardly directed end to the normally downwardly directed end for allowing the device to be easily lifted over the bag after the bag has been filled. Additionally, the body member preferably includes at least one aperture located substantially adjacent the normally downwardly directed end for allowing escapage of air from within the cavity when the bag is inserted into the cavity.

DESCRIPTION OF THE PREFERRED EMBODIMENT

The device 11 of the present invention is for holding a flexible, nonselfsupporting bag B such as a typical plastic garbage bag or the like in an opened position to allow the bag to be filled with trash T such as leaves, grass or the like.

Figure 1:
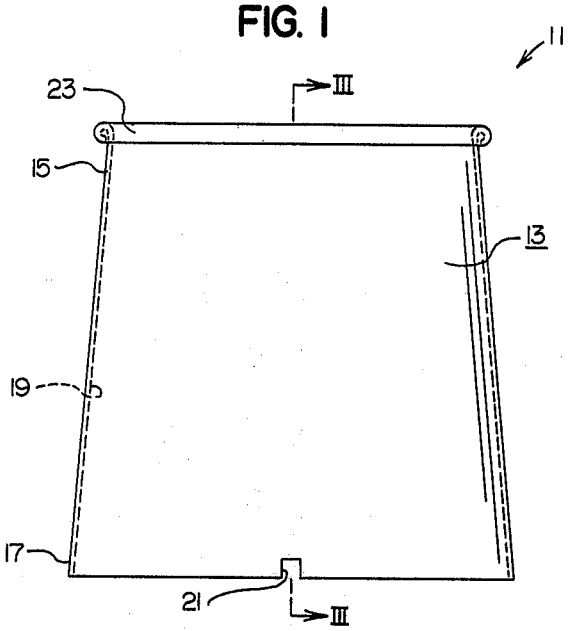
FIG. 1 is a front elevational view of the device for holding a flexible, nonselfsupporting bag in an opened position of the present invention.
Figure 2:
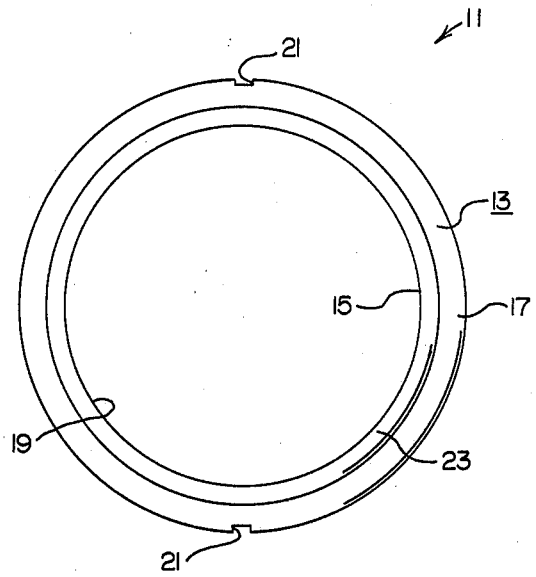
FIG. 2 is a top plan view thereof.
Figure 3:
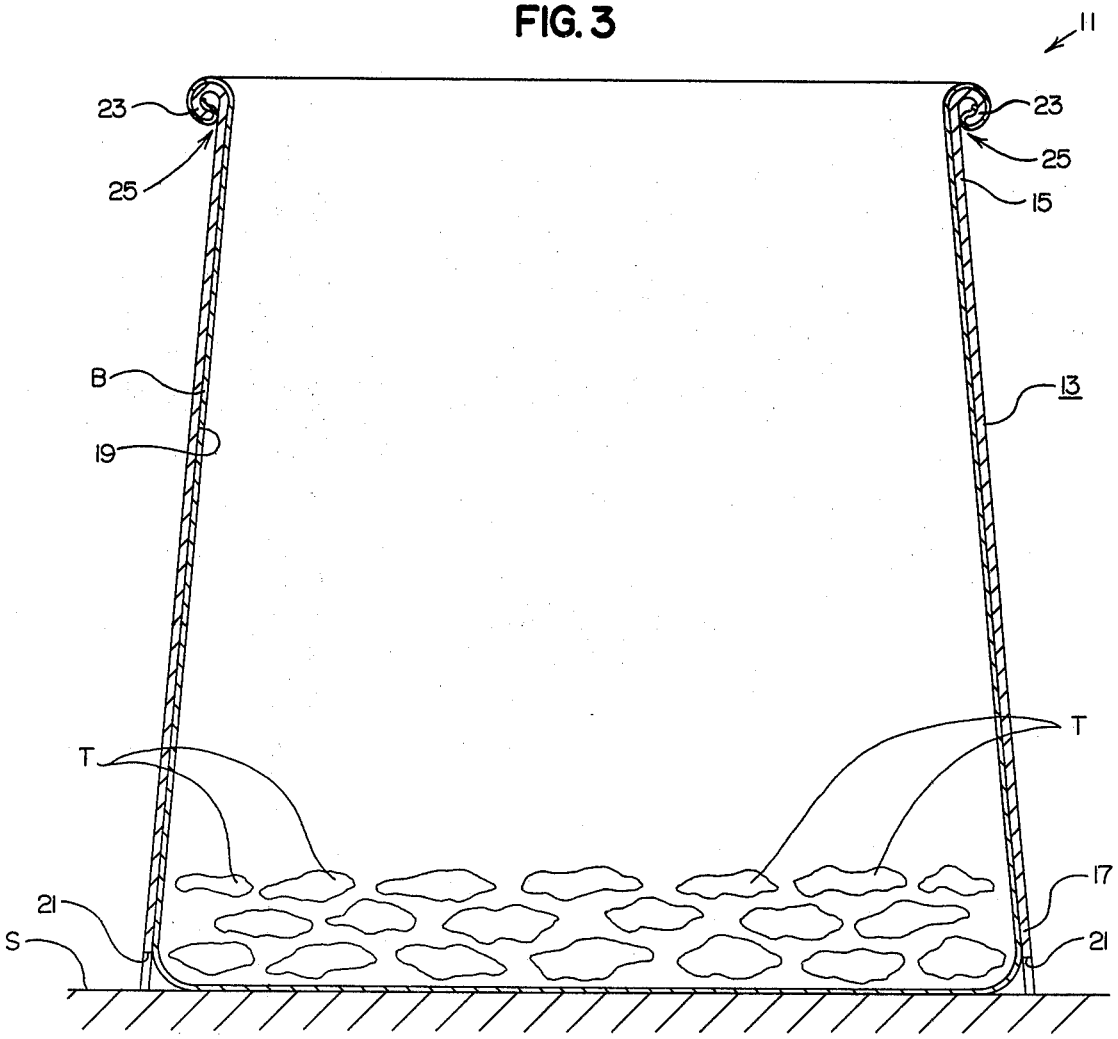
FIG. 3 is an enlarged sectional view thereof as taken on line III—III of FIG. 1, showing the device supported on a supporting surface and holding a flexible, nonselfsupporting bag in an opened position.

The device 11 includes a body member 13 having a normally upwardly directed first end 15 and a normally downwardly directed second end 17. The body member 13 has a cavity 19 extending completely therethrough from the first end 15 to the second end 17 for receiving the bag B substantially as shown in FIG. 3. The cavity 19 preferably constantly increases in cross-sectional area as it extends from the first end 15 to the second end 17 as clearly shown in FIGS. 1 and 3 for allowing the device 11 to be easily lifted over the bag B after the bag B has been filled. The wall of the cavity 19 is preferably smooth to reduce the friction between the bag B and the body member 13 when the device 11 is lifted over the bag B. The body member 13 also preferably includes at least one aperture located substantially adjacent the second end 17 for allowing escapage of air from within the cavity 19 when the bag B is inserted into the cavity. More specifically, the body member 13 preferably has a pair of opposed notch-like apertures 21 located transverse to the cavity 19 and conterminous with the cavity 19 and the second end 17 of the body member 13 as clearly shown in the drawings. The wall of the body member 13 is preferably constructed of a substantially thin (e.g., ¼ inch; 0.635 centimeters) plastic material. Both the cavity 19 and the body member 13 are preferably in the shape of a truncated cone as clearly shown in FIGS. 1 and 2.

The device 11 preferably includes a lock means for selectively locking or holding the bag B to the body member 13. The lock means may include a substantially downturned hook member 23 fixedly attached to the outer edge of the first end 15 of the body member 13 (see, in general, FIG. 3). The hook member 23 preferably extends completely about the first end 15 of the body member 13 as clearly shown in FIGS. 1 and 2. The hook member 23 is preferably integrally constructed with the body member 13 and preferably consists simply of a portion of the first end 15 of the body member 13 being turned back upon itself to form a hook. To attach the bag B to the device 11, the mouth of the bag B is merely turned back upon the first end 15 of the body member 13 and portions thereof stuffed are inserted into the gap 25 between the hook member 23 and the body member 13 as shown in FIG. 3. It should be noted that the hook member 23 can also act as a handle for allowing the device 11 to be pinched up, moved, etc.

The body member 13 and the hook member 23 are preferably integrally molded as a one-piece unit out of any hard plastic material known to those skilled in the art in any manner known to those skilled in the art. Also, it should be noted that the device 11 may be constructed in different sizes for use with different size bags B. That is, the device 11 may be constructed in one size for use of 55 gallon bags B, another size for use of 30 gallon bags B, etc.

The use of the device 11 is very simple. First, a bag B is selected having substantially the same capacity as the cavity 19. Next, the bottom of the bag B is dropped inside the cavity 19 and the top or mouth of the bag B is opened and secured to the hook member 23 by being turned or cuffed back on the first end 15 of the body member 13 and being inserted or stuffed into the gap 25 as shown in FIG. 3. The device 11 can then be held into the wind or whirled around so that air pressure will inflate the bag B inside the body member 13. The device 13 is then placed on a supporting surface S with the second end 17 resting on the supporting surface S. The bag B can then be filled with trash T without danger of tearing or mutilating it. As the bag B is being filled, there will be no trapping of air between the bag B and the wall of the cavity 19 since air will pass through the notch-like apertures 21 in the base of the body member 13 as the bag B is filled. After the bag B has been filled to its capacity, the top or mouth of the bag B is released from the hook member 23 and secured with ties or the like. Next, the device 11 is merely lifted over the filled bag B. Because the walls of the cavity 19 taper outwardly from the top thereof and are smooth, no difficulty will be encountered in lifting the device 11 over the bag B.

As thus constructed and used, the present invention provides a device that, in addition to aiding the homeowner in bagging leaves, cut grass and the like, is superior to many types of refuse containers now being marketed. For example, the present invention provides a much superior sanitary refuse container for hospitals, restaurants, etc., because, when provided with a removable lid or top, it becomes an outstanding refuse container that does not have inherent unsanitary conditions built in (i.e., it has no bottom). Also, the device 11 can be used as a refuse container in parks, malls and the like. A concrete base (not shown) may be provided for receiving the second end 17 of the body member 13 in such a manner that the device 11 will be prevented from being turned over by wind or the like but which still allows the devide 11 to be lifted over a filled bag B.

Although the invention has been described and illustrated with respect to a preferred embodiment thereof, it is not to be so limited since changes and modifications may be made therein which are within the full intended scope of the invention.

I claim:

1. A device for holding a flexible, nonselfsupporting bag in an opened position to allow said bag to be filled, said device comprising: a one-piece body member including a continuous side wall member and having a normally upwardly directed end and a normally downwardly directed end, said body member having a cavity extending completely therethrough from said normally upwardly directed end to said normally downwardly directed end for receiving said bag, said side wall having one or more apertures therethrough adjacent and conterminous with said normally downwardly directed end for allowing escapage of air from within said cavity when said bag is inserted into said cavity, said side wall being solid except for said one or more apertures, said cavity constantly increasing in cross-sectional area as it extends from said normally upwardly directed end to said normally downwardly directed end for allowing said device to be easily lifted over said bag after said bag has been filled.

2. The device of claim 1 in which said body member includes a plurality of said apertures.

3. The device of claim 1 in which is included lock means for selectively holding said bag to said body member, said lock means being attached to said normally upwardly directed end of said body member.

4. The device of claim 3 in which said lock means includes a substantially downturned hook member fixedly attached to the outer edge of said normally upwardly directed end of said body member.

5. The device of claim 4 in which said hook member extends completely about said normally upwardly directed end of said body member.

6. The device of claim 1 in which said body member is in the shape of a hollow, truncated cone.

7. The device of claim 1 in which the walls of said cavity are smooth.

8. The combination with a flexible, nonselfsupporting garbage bag of a device for holding said bag in an opened position to allow said bag to be filled, said device comprising:

(a) a hollow one-piece body member including a continuous side wall member and having a normally upwardly directed first end and a normally downwardly directed second end, said body means having a cavity extending completely therethrough, said bag being received in said cavity, said cavity having smooth walls and constantly increasing in cross-sectional area as it extends from said first end to said second end for allowing said device to be easily lifted over said bag after said bag has been filled, said side wall member having one or more apertures therethrough located adjacent and conterminous with said second end for allowing escapage of air from within said cavity when said bag is inserted into said cavity, said side wall being solid except for said one or more apertures; and (b) lock means holding said bag to said body member, said lock means including a substantially downturned hook member fixedly attached to said first end of said body member.

* * * * *